US008422869B2

(12) United States Patent
Joseph

(10) Patent No.: US 8,422,869 B2
(45) Date of Patent: Apr. 16, 2013

(54) HANDHELD LOW-VOLTAGE FOG EFFECTS SYSTEM

(75) Inventor: Daniel M. Joseph, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 682 days.

(21) Appl. No.: 12/639,719

(22) Filed: Dec. 16, 2009

(65) Prior Publication Data

US 2011/0142429 A1 Jun. 16, 2011

(51) Int. Cl.
*A61H 33/06* (2006.01)
*A61H 33/12* (2006.01)

(52) U.S. Cl.
USPC ..... 392/394; 392/386; 392/404

(58) Field of Classification Search ..... 392/386, 392/394, 404
See application file for complete search history.

(56) References Cited

U.S. PATENT DOCUMENTS

| | | | | | |
|---|---|---|---|---|---|
| 2,324,359 | A * | 7/1943 | Callan | 446/24 |
| 3,458,948 | A * | 8/1969 | Schlensker et al. | 43/129 |
| 4,297,563 | A * | 10/1981 | Berry | 392/398 |
| 4,480,172 | A * | 10/1984 | Ciciliot et al. | 392/396 |
| 4,493,211 | A * | 1/1985 | Weinstein | 73/147 |
| 4,741,717 | A * | 5/1988 | Wolf | 446/24 |
| 4,871,115 | A * | 10/1989 | Hessey | 239/136 |
| 6,053,435 | A * | 4/2000 | Hung | 239/590 |
| 6,094,523 | A * | 7/2000 | Zelina et al. | 392/399 |
| 6,421,502 | B1 * | 7/2002 | Aronie et al. | 392/399 |
| 6,804,458 | B2 * | 10/2004 | Sherwood et al. | 392/397 |
| 6,826,355 | B2 * | 11/2004 | Aronie et al. | 392/399 |
| 7,086,920 | B2 * | 8/2006 | Fusco | 446/15 |
| 7,117,867 | B2 * | 10/2006 | Cox et al. | 128/200.14 |
| 7,128,067 | B2 * | 10/2006 | Byron et al. | 128/200.14 |
| 7,302,170 | B1 * | 11/2007 | Chen | 392/398 |
| 7,845,359 | B2 * | 12/2010 | Montaser | 131/273 |
| 2003/0202785 | A1 * | 10/2003 | Monitto | 392/399 |
| 2008/0230052 | A1 * | 9/2008 | Montaser | 128/200.16 |
| 2010/0142933 | A1 * | 6/2010 | Vandoninck | 392/386 |
| 2011/0011396 | A1 * | 1/2011 | Fang | 128/202.21 |

FOREIGN PATENT DOCUMENTS

DE 102010014206 A1 * 11/2010

* cited by examiner

*Primary Examiner* — Thor Campbell
(74) *Attorney, Agent, or Firm* — Patterson & Sheridan, LLP

(57) ABSTRACT

A fog effects system includes a control system, a fog fluid reservoir, an elongated insulator, an elongated electric heating element, an air supply subsystem, a fog fluid supply subsystem, and a handheld body. The control system can include a battery-operated power supply and a user-operable control. The heating element extends along the insulator. The control system electrically energizes the heating element during system operation. The air supply subsystem directs a flow of air along the heating element during system operation. The fog fluid supply supplies fog fluid to the flow of air. The heating element vaporizes the fog fluid, which is emitted from an end of the system.

14 Claims, 8 Drawing Sheets

HANDHELD LOW-VOLTAGE FOG EFFECTS SYSTEM

BACKGROUND

A fog machine is a device that emits a stream or puff of visible vapor or fog for theatrical or similar purposes. The effect can be enhanced by projecting light through the emitted fog to provide a dramatic visual effect on stage, in a dance club, etc. A fog machine operates by pumping a non-toxic fog fluid, such as glycol, glycerine, or a water-based mixture thereof, into an airstream and past a heating element. The airstream is typically provided by a fan. The heating element causes the fluid to vaporize, producing a visible vapor or fog.

Fog machines are typically portable but not especially compact, generally having a boxy shape with a size on the order of that of a small suitcase or briefcase and weighing on the order of 5-10 pounds (2.25-4.5 kilograms) or more. Most fog machines are powered by utility power, i.e., they must be plugged into a wall outlet, portable generator or similar source of utility-level power. Accordingly, fog machines are typically brought to an unobtrusive location in a corner of a theater stage or other location where a performance or other activity is to take place, left in place throughout the activity, and used at times during the activity to produce fog. Compact, battery-powered fog machines have been developed, but remain uneconomical due to complex, specialized parts.

SUMMARY

Embodiments of the present invention relate to a system for generating fog effects. An exemplary system can include a control system, a fog fluid reservoir, an elongated insulator, an elongated electric heating element, an air supply subsystem, a fog fluid supply subsystem, and a handheld body.

The control system can include a battery-operated power supply and a user-operable control such as a switch. The control system initiates system operation at least in part in response to the user-operated control. The heating element extends along the insulator and is coupled to the control system. The control system electrically energizes the heating element during system operation. The air supply subsystem is coupled to the control system and directs a flow of air in a direction along the heating element from an intake end toward an exhaust end during system operation. The fog fluid supply subsystem is coupled to the fog fluid reservoir and the control system, and supplies fog fluid to the flow of air during system operation.

The handheld body has an opening substantially adjacent to the exhaust ends of the heating element and insulator and contains the battery-operated power supply, the fog fluid reservoir, the insulator, the heating element, the air supply subsystem, and the fog fluid supply subsystem. In some embodiments, the body can also be elongated and resemble an object that characteristically burns, such as torch, cigar, etc. In this manner the handheld fog effects system can be used as an acting prop, toy or similar device.

Other systems, methods, features, and advantages of the invention will be or become apparent to one of skill in the art to which the invention relates upon examination of the following figures and detailed description. All such additional systems, methods, features, and advantages are encompassed by this description and the accompanying claims.

BRIEF DESCRIPTION OF THE FIGURES

The invention can be better understood with reference to the following figures. The elements shown in the figures are not necessarily to scale, emphasis instead being placed upon clearly illustrating the principles of the invention. Also, in the figures like reference numerals designate corresponding elements throughout the different views.

DETAILED DESCRIPTION

Figure 1:
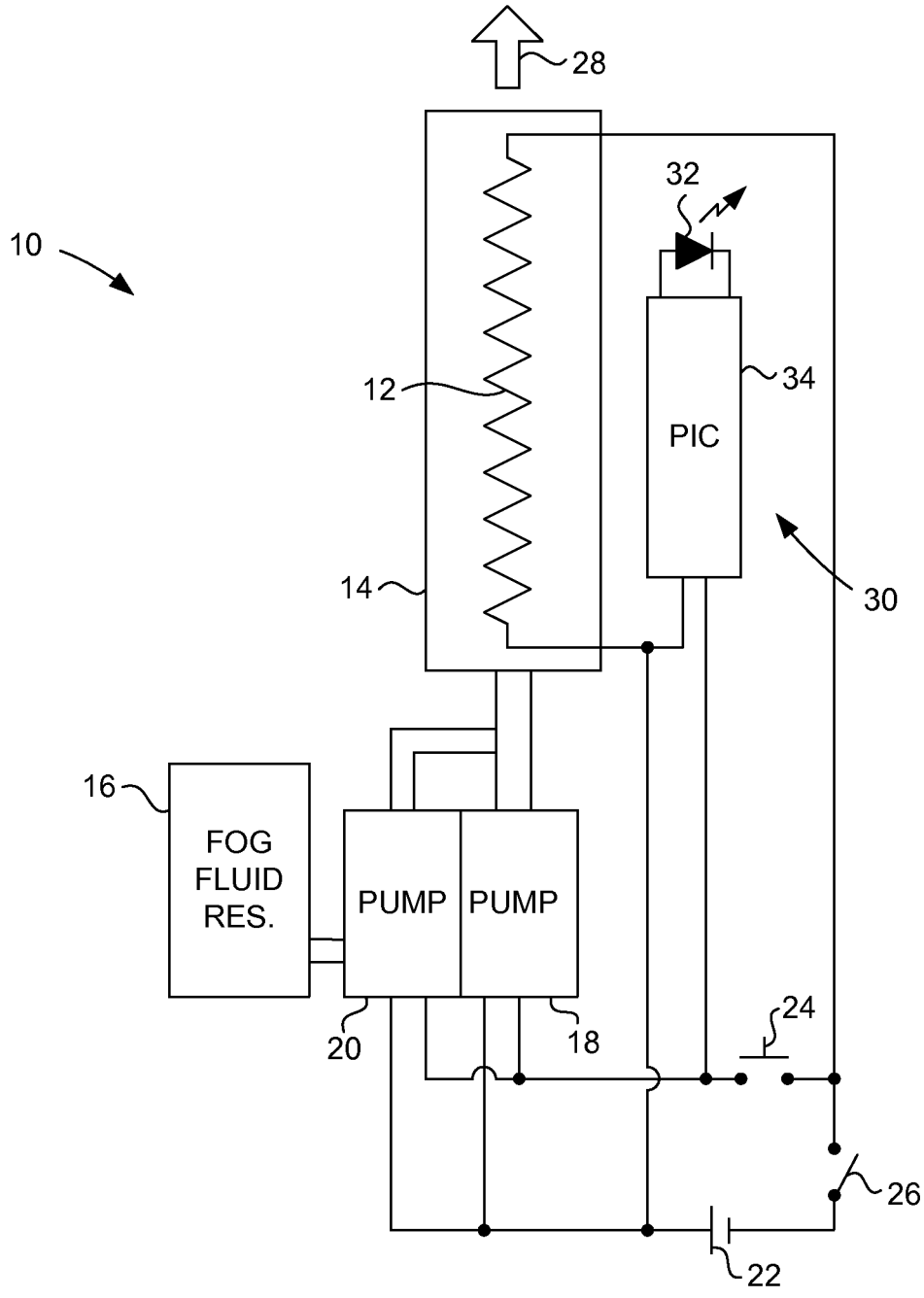
FIG. 1 is a block diagram of a fog effects system, in accordance with an exemplary embodiment of the invention.

As illustrated in FIG. 1, in an illustrative or exemplary embodiment of the invention, a fog effects system comprises a fog generator system 10 that includes a heating element 12, an insulator 14, a fog fluid reservoir 16, an air pump 18, and a liquid pump 20. Fog generator system 10 further includes a battery-operated power supply 22 that includes one or more batteries and associated electrical connectors or other power supply elements. Power supply 22 can employ, for example, four AA-size (1.5 volt) batteries connected in series with each other to produce 6 volts. Fog generator system 10 also includes two user-operable switches 24 and 26 or similar controls. In this exemplary embodiment, power supply 22, switches 24 and 26 and associated electrical connections can together define a control system. However, in other embodiments control systems can include additional or different electronic or mechanical elements. Similarly, although in the exemplary embodiment air pump 18 and associated electrical, pneumatic and mechanical connections (described below in further detail) can define an air supply subsystem, and liquid pump 20 and associated electrical, fluid and mechanical connections (described below in further detail) can define a fog fluid supply subsystem, in other embodiments air supply subsystems and fog fluid supply subsystems can include additional or different electronic, fluid, pneumatic, mechanical, etc. elements. For example, in an alternative embodiment (not shown) the air supply subsystem can include a controllable valve, vane, flap, etc. for directing the flow of air, instead of or in addition to energizing the air pump. Similarly, the fog fluid supply subsystem can include other such controllable elements. Alternatively to being controllable, in some embodiments such elements can be fixed or otherwise passive. Also, in such other embodiments, the liquid pump, air pump, or both can be operated manually rather than electrically. Indeed, in some embodiments, one of the fog fluid supply subsystem and the air supply subsystem need not include a pump at all. Rather, for example, the fog fluid supply system can produce a stream of fog fluid that is sufficiently atomized without the use of an air pump. Also, in other embodiments, the control system and elements that it controls can be configured to cause the fog to be emitted in a specific pattern or other manner, such as in a puff of predetermined duration, a series of puffs, a continuous stream, a pseudo-random manner, or any other desired manner, to create any desired effect.

In the illustrated embodiment, when a user closes switch 26, which can be, for example, a miniature slide switch, heating element 12 is electrically coupled to battery-operated power supply 22 and therefore energized. When energized, heating element 12, which can be, for example, a nickel-chromium or nichrome resistance wire, quickly becomes hot. Then, when a user closes switch 24, which can be, for example, a momentary-contact pushbutton switch, air pump 18 and liquid pump 20 are each electrically coupled to battery-operated power supply 22 and therefore energized. Air pump 18 can be any suitable pump that can deliver a flow of air, such as a diaphragm pump. When energized, air pump 18 pumps air into an intake end of insulator 14, which can be, for example, a hollow tube made of ceramic, glass or similar heat-insulating material. Liquid pump 20 can be any suitable pump that can deliver a liquid in a controlled manner, such as a peristaltic pump. When energized, liquid pump 20 pumps fog fluid from fog fluid reservoir 16 into the flow of air or airstream at the intake end of insulator 14. Heating element 12 is aligned along insulator 14 and has an intake end corresponding to the intake end of insulator 14 and an exhaust end corresponding to the exhaust end of insulator 14. At the intake ends of heating element 12 and insulator 14, the heat emitted by heating element 12 begins to vaporize the fog fluid that is carried in the air stream. The vaporization continues as the fog fluid is conveyed through the airstream along the length of heating element 12 and insulator 14 toward the exhaust ends of heating element 12 and insulator 14. The vapor or fog is emitted at the exhaust ends of heating element 12 and insulator 14, as indicated by the arrow 28.

The fog effects system can also include an illumination system 30 to illuminate the fog emanating from fog generator system 10 for an added dramatic effect. Illumination system 30 can comprise one or more electrical lighting elements, such as light-emitting diodes (LEDs) 32 (only one of which is shown in FIG. 1 for purposes of clarity, but several are connected together in parallel in the exemplary embodiment), and a lighting controller 34. Lighting controller 34 controls the operation of LEDs 32 by, for example, causing them to flash in a manner that provides a flickering effect that evokes an appearance of flames or fire. Lighting controller 34 can include, for example, a programmable interface controller (PIC) device, which is a well-known device that is commercially available from a variety of sources. As persons skilled in the art understand how PIC devices are programmed and connected, these aspects are not described herein. The LEDs 32 can include a combination of red, amber and white or other colored LEDs that emit colors resembling those of fire, and lighting controller 34 can cause the various colors to alternately flash in a manner that resembles the changing colors of a flickering fire. Although not shown for purposes of clarity, lighting controller 34 is coupled to an output of the above-described control system of fog generator 10 that includes switch 24 so that when a user presses switch 24 lighting controller 34 activates LEDs 32 to illuminate the emitted fog. Although in the exemplary embodiment lighting controller 34 of illumination system 30 is somewhat separate from the control system of fog generator 10, in other embodiments the lighting control functions and fog generator control functions can be integrated or combined with each other using, for example, a single PIC device or similar controller to control these functions and others.

Figure 2:
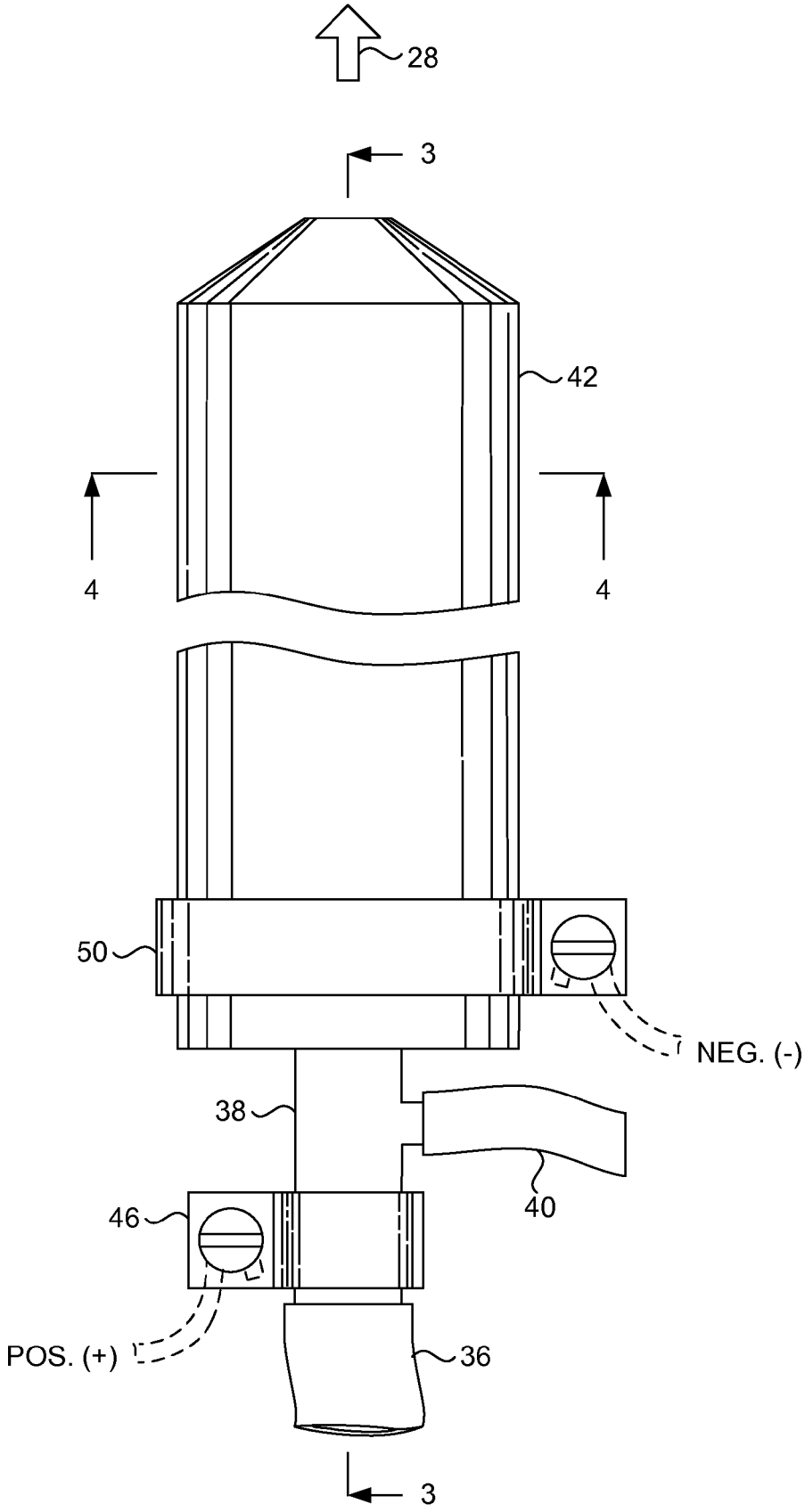
FIG. 2 is a side elevation view of a portion of the fog effects system of FIG. 1.
Figure 3:
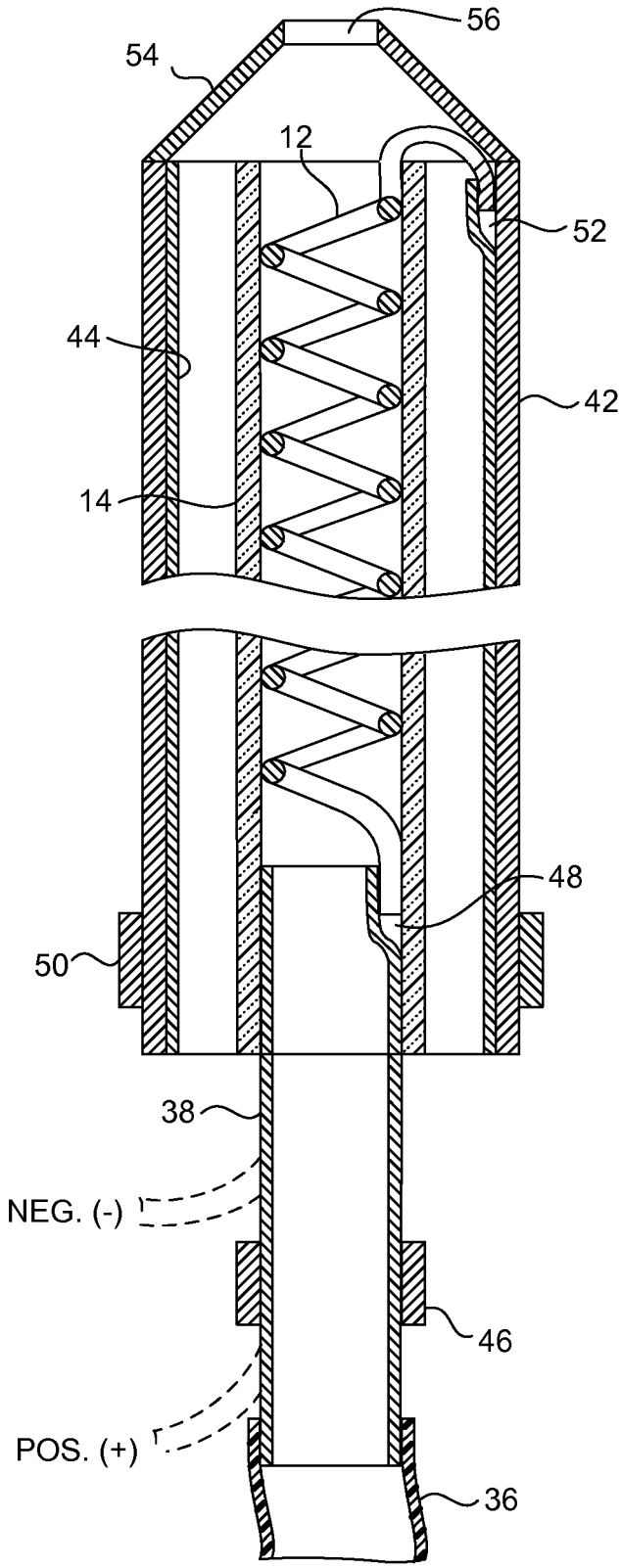
FIG. 3 is a sectional view taken on line 3-3 of FIG. 2.
Figure 4:
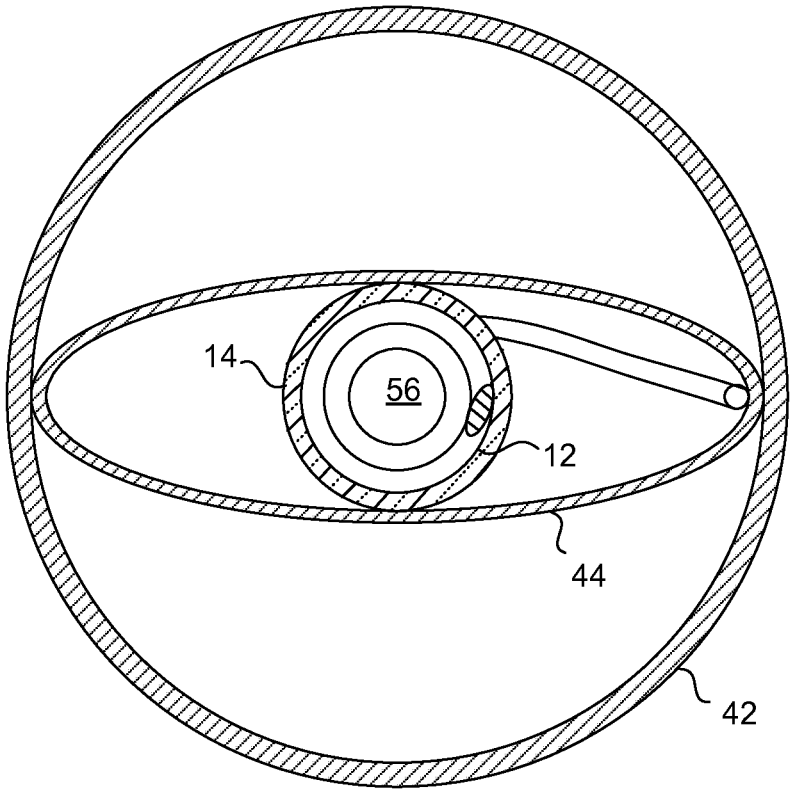
FIG. 4 is a sectional view taken on line 4-4 of FIG. 2.

As illustrated in FIGS. 2-4, an air hose 36 delivers air from air pump 18 to a coupling tube 38, which is connected to the intake end of the (tubular) insulator 14. Similarly, a liquid hose 40 delivers fog fluid from liquid pump 20 to coupling tube 38. In the exemplary embodiment, heating element 12 has a helical shape and is disposed within insulator 14, as best shown in FIG. 2. Insulator 14 can be made of a suitable heat-insulating material, such as ceramic. Insulator 14 is, in turn, disposed within an outer tube 42 and held in place by a retaining tube 44. Retaining tube 44 has a flattened or elliptical cross-sectional shape that squeezes or holds insulator 14 centered within retaining tube 44. Although in other embodiments (not shown) an insulator can be retained in any other suitable manner, such as by one or more spacers (not shown) extending between the insulator and the outer tube or similar outer structure, the flattened tube of the exemplary embodiment provides the retaining function in a manner that can be economically manufactured from readily available metal tubes. Outer tube 42 and retaining tube 44 can be made of economical but durable materials such as aluminum or brass. The heat-insulating property of insulator 14 and the air gaps between insulator 14 and retaining tube 44 and between retaining tube 44 and outer tube 42 insulate outer tube 42 against becoming unsafely or uncomfortably hot, thereby facilitating use of the fog effects system as part of a toy, prop, costume, etc., worn or held by a person. Although tubes 42 and 44 are metal tubes in the exemplary embodiment, in other embodiments (not shown) analogous structures can have any other suitable shapes and compositions. Although in the exemplary embodiment outer tube 42 serves as one of the electrical conductors for powering heating element 12 (as described below in further detail), in embodiments (not shown) in which the tubes or other structures are made of a non-conductive material, a separate electrical conductor can be included.

A first clamp-like ring terminal 46 can be attached to coupling tube 38 to electrically couple one side or polarity output, e.g., a positive polarity output, of the above-described control system to heating element 12. The proximal end (i.e., intake end) of heating element 12 can be electrically coupled to coupling tube 38 by, for example, friction-fitting it within a groove-like indentation 48 in coupling tube 38 between the outer wall of coupling tube 38 and the inner wall of insulator 14, as best shown in FIG. 3. A second clamp-like ring terminal 50 can be attached to outer tube 42 to electrically couple the other side or polarity output, e.g., a negative polarity output, of the above-described control system to heating element 12. The distal end (i.e., exhaust end) of heating element 12 can be electrically coupled to retaining tube 44 by, for example, friction-fitting it within a groove-like indentation 52 in retaining tube 44 between the outer wall of retaining tube 44 and the inner wall of outer tube 42, as best shown in FIG. 3.

In operation, liquid pump 20 pumps fog fluid from fog fluid reservoir 16 into the airstream produced by air pump 18. The hot heating element 12 vaporizes the fog fluid as the fog fluid suspended in the airstream migrates along the length of heating element 12 from its proximal or intake end toward its distal or exhaust end. The relatively long region in which the fog fluid suspended in the airstream can absorb the heat emitted by heating element 12 promotes complete vaporization despite the relatively low voltage (for example, 6 volts) applied to heating element 12 by battery-operated power supply 22.

A frusto-conical nozzle 54 having an exhaust opening 56 is attached to the distal end (i.e., exhaust end) of outer tube 42, with exhaust opening 56 adjacent to the exhaust ends of heating element 12 and insulator 14. In operation, the fog effects system emits the vapor or fog through exhaust opening 56.

Figure 5:
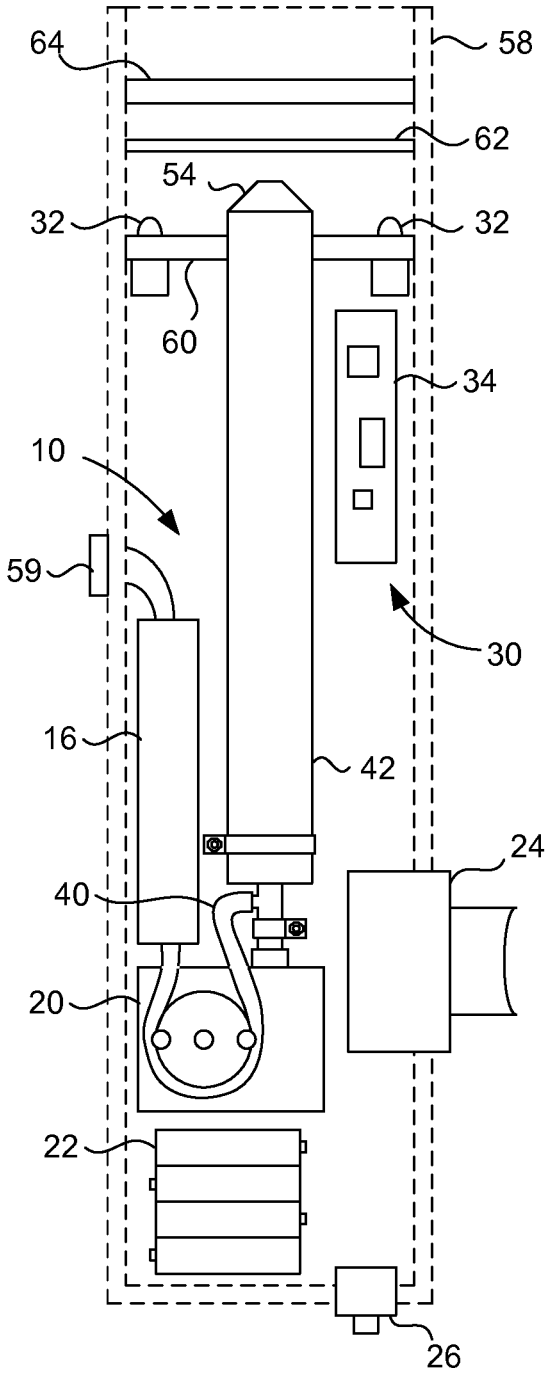
FIG. 5 is a side elevation view of the exemplary fog effects system of FIG. 1.
Figure 6:
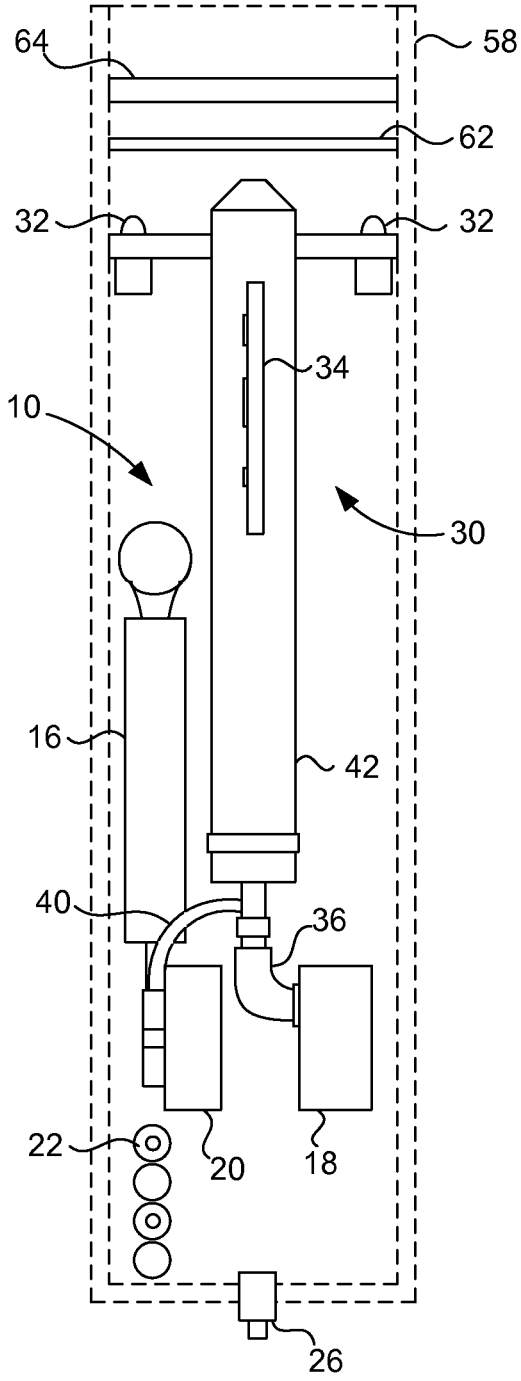
FIG. 6 is a similar to FIG. 5, showing another side of the exemplary fog effects system.

As illustrated in FIGS. 5-6, fog generator system 10 and illumination system 30 can be mounted within a body 58. Switches 24 and 26 can be mounted in walls of body 58 to facilitate their operation by a user (not shown). The LEDs 32 of illumination system 30 can be mounted around the periphery of a ring 60 near nozzle 54. A perforated disk 62 can be mounted adjacent nozzle 54 to aid dispersing or inducing laminar flow of the vapor or fog. Similarly, a grating 64, which can have hexagonal openings (not shown) arrayed in a honeycomb fashion, can similarly aid dispersing the vapor or fog. A user can fill fog fluid reservoir 16 through a removable cap 59.

Figure 7:
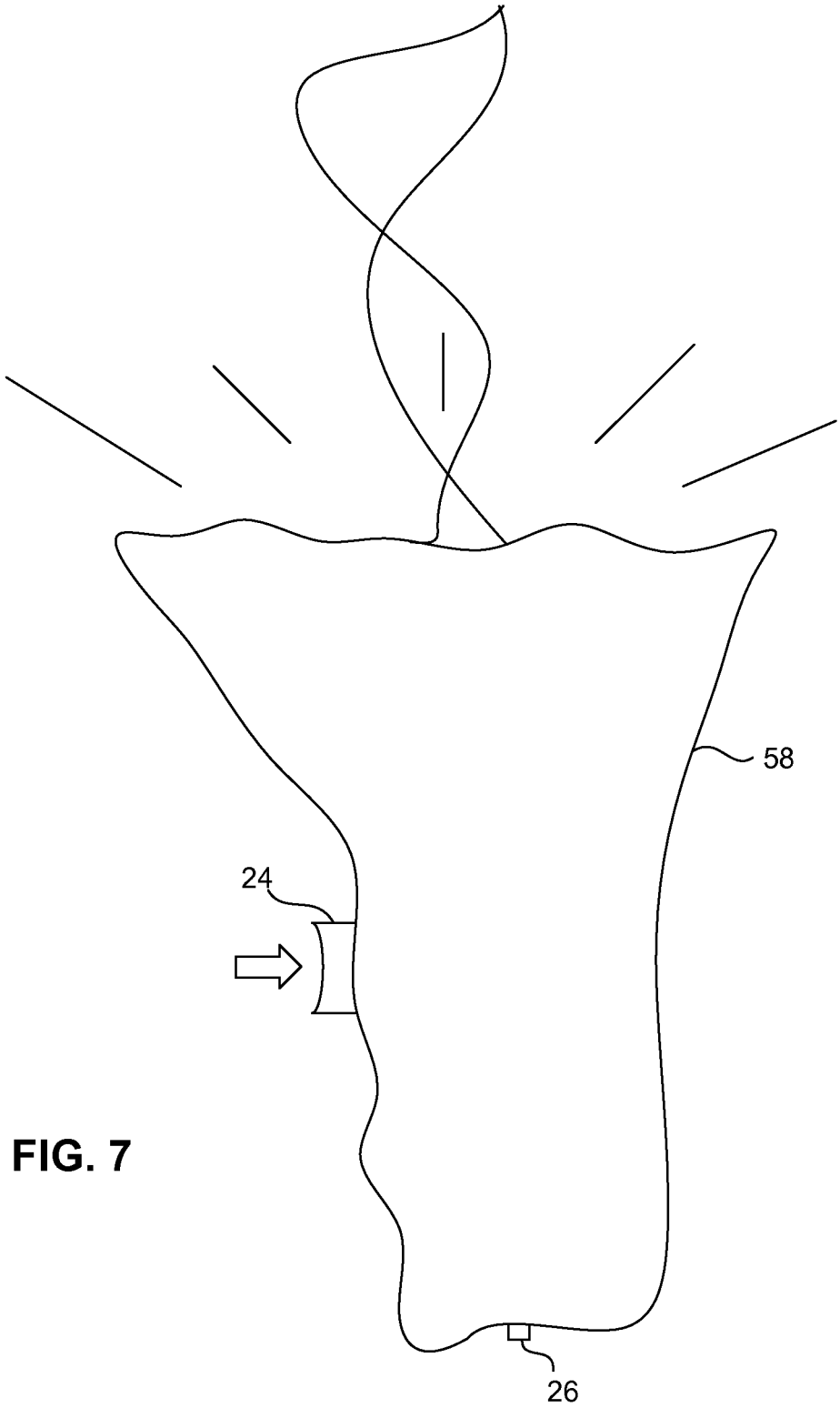
FIG. 7 is a side elevation view of the exemplary fog effects system of FIG. 1, housed in a body resembling a torch.
Figure 8:
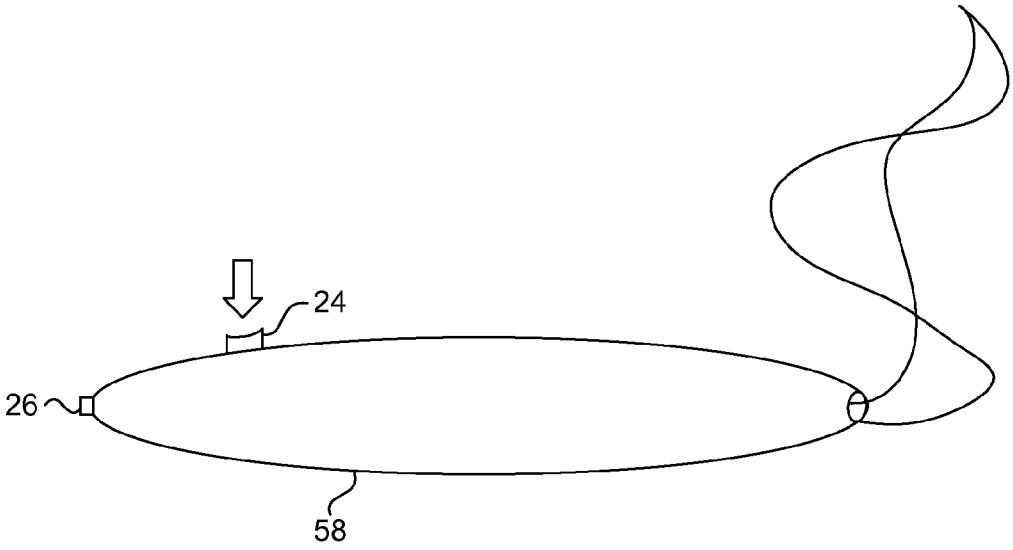
FIG. 8 is a side elevation view of the exemplary fog effects system of FIG. 1, housed in a body resembling a cigar.

Body 58 is shown in broken line in FIG. 5 to indicate that it need not have the indicated cylindrical shape. Rather, body 58 can have a shape that resembles an object that characteristically burns, such as the torch shape shown in FIG. 7 or the cigar shape shown in FIG. 8. An actor, for example, can hold a fog effects system having a torch-shaped body 58 in his hand and use it as a prop to simulate a burning torch. Note that switch 24 is mounted in an orientation in or on body 58 that facilitates button 24 to be actuated by the user's finger in a trigger-like manner when the user (not shown) is gripping body 58. When the actor or other user presses button 24, the fog effects system emits a stream of fog and generates flickering light. The simulated smoke and the flickering light combine to create an effect that is evocative of the fire in a torch.

Similarly, an actor can hold a fog effects system having a cigar-shaped body 60 in his hand and use it as a prop to simulate a burning cigar. When the actor or other user presses switch 24, the fog effects system emits a puff of fog and generates a glowing light. The simulated smoke and glowing light combine to create an effect that is evocative of a burning cigar. In view of these descriptions, persons skilled in the art can readily provide fog effects systems having bodies with other shapes that simulate or resemble any other such handheld objects that are characteristically used in a burning state.

It should be noted that embodiments in which operation is initiated in a trigger-like manner especially lend themselves to the inclusion of a manually operated or otherwise non-electrically-operated fog fluid supply subsystem, air supply subsystem, or both. For example, a manually operated fog fluid pump (not shown) can have a trigger resembling button 24 shown in FIG. 5. The force that the user's finger applies to the trigger operates the fog fluid pump.

Furthermore, in other embodiments (not shown) one of the fog fluid supply subsystem and the air supply subsystem can operate more passively than the other. For example, in some embodiments the fog fluid introduced by the fog fluid supply subsystem is flash-vaporized so rapidly that as it changes from a liquid to a gas the expanding gas creates such a sufficient flow of the vapor out of the exhaust end that no air pump is needed. In such embodiments the air supply subsystem serves to passively direct the flow. It should be noted that although in the embodiment described above both the fog fluid supply subsystem and air supply subsystem are electrically operated (i.e., both air pump 18 and a liquid pump 20 are electrically operated), in other embodiments neither the fog fluid supply subsystem nor the air supply subsystem need be electrically operated. For example, the fog fluid pump can be manually operated, and the air supply subsystem can operate passively, directing the expanding vapor out the exhaust end.

While one or more embodiments of the invention have been described as illustrative of or examples of the invention, it will be apparent to those of ordinary skill in the art that other embodiments are possible that are within the scope of the invention. Accordingly, the scope of the invention is not to be limited by such embodiments but rather is determined by the appended claims.

What is claimed is:

1. A fog effects system, comprising:

a control system including a battery-operated power supply and a user-operable control, the control system initiating at least a portion of system operation in response to the user-operated control;

a fog fluid reservoir;

an elongated insulator;

an elongated electric heating element extending along the insulator and coupled to the control system, the heating element having an intake end and an exhaust end, the control system electrically energizing the heating element during system operation;

an air supply subsystem coupled to the control system, the air supply subsystem directing a flow of air along the heating element from the intake end toward the exhaust end during system operation;

a fog fluid supply subsystem coupled to the fog fluid reservoir and the control system, the fog fluid supply subsystem supplying, during system operation, fog fluid to the flow of air before the flow of air enters the intake of the heating element; and a handheld body having an opening substantially adjacent to the exhaust end of the heating element, the handheld body containing the battery-operated power supply, the fog fluid reservoir, the insulator, the heating element, the air supply subsystem, and the fog fluid supply subsystem.

2. The fog effects system claimed in claim 1, wherein:

the insulator is tubular and ceramic; and the heating element extends within the insulator.

3. The fog effects system claimed in claim 2, wherein:

the air supply subsystem comprises an air pump coupled to the control system, the control system energizing the air pump in response to the user-operable switch.

4. The fog effects system claimed in claim 3, wherein:

the fog fluid supply subsystem comprises a liquid pump coupled to the control system, the control system energizing both the air pump and the liquid pump in response to the user-operable switch.

5. The fog effects system claimed in claim 4, wherein the air pump is a diaphragm pump.

6. The fog effects system claimed in claim 4, wherein the liquid pump is a peristaltic pump.

7. The fog effects system claimed in claim 1, further comprising:

at least one electrical lighting element substantially adjacent the exhaust end of the heating element and oriented to illuminate fog emanating from the opening; and a lighting controller, the lighting controller controlling operation of the electrical lighting element.

8. The fog effects system claimed in claim 7, wherein the electrical lighting element emits a color resembling a color of fire.

9. The fog effects system claimed in claim 7, wherein the lighting controller is coupled to the electrical lighting element emits a color resembling a color of fire.

10. The fog effects system claimed in claim 7, wherein the lighting controller is coupled to the control system, the control system causing the lighting controller to electrically energize the heating element during system operation.

11. The fog effects system claimed in claim 1, wherein the body is substantially elongated and resembles an object that characteristically burns.

12. The fog effects system claimed in claim 11, wherein the body resembles a torch.

13. The fog effects system claimed in claim 11, wherein the body resembles a cigar.

14. The fog effects system claimed in claim 11, wherein the user-operated control comprises a switch mounted in the body in a trigger-like position relative to a grip portion of the body.

* * * * *